US007025109B1

(12) United States Patent
Ward et al.

(10) Patent No.: US 7,025,109 B1
(45) Date of Patent: Apr. 11, 2006

(54) METHOD AND APPARATUS FOR CONTROLLING DISPERSION OF MOLTEN METAL IN A MOLD CAVITY

(75) Inventors: Gary C. Ward, Saline, MI (US); Barry L. Priem, Saginaw, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/100,049

(22) Filed: Apr. 6, 2005

(51) Int. Cl.
*B22C 9/04* (2006.01)

(52) U.S. Cl. ..... 164/34; 164/45; 164/235

(58) Field of Classification Search ..... 164/34, 164/45, 235
See application file for complete search history.

(56) References Cited

U.S. PATENT DOCUMENTS 4,711,288 A * 12/1987 Harvey ..... 164/34
6,619,373 B1 9/2003 Tooley et al. ..... 164/363

* cited by examiner

*Primary Examiner*—Kuang Y. Lin
(74) *Attorney, Agent, or Firm*—Charles H. Ellerbrock

(57) ABSTRACT

A method and apparatus for controlling the dispersion of molten metal in a mold cavity is disclosed, the control facilitated by a localized densification of foam in a lost foam casting operation for producing metal castings, wherein the filling of regions of the mold cavity which do not lend themselves to castability is maximized, an amount of back-fill and casting defects are minimized, and a flow pattern of molten metal and material properties of the resulting casting are optimized.

14 Claims, 3 Drawing Sheets

METHOD AND APPARATUS FOR CONTROLLING DISPERSION OF MOLTEN METAL IN A MOLD CAVITY

FIELD OF THE INVENTION

The invention relates to lost foam casting and more particularly to a method and apparatus for controlling dispersion of molten metal in a mold cavity in a lost foam casting process for producing metal castings, wherein the control is facilitated by a localized densification of the foam.

BACKGROUND OF THE INVENTION

A so-called "lost-foam" casting process is a well-known technique for producing metal castings. A fugitive, pyrolizable, polymeric, foam pattern (including casting, gating, runners, and sprue) is covered with a thin (typically in the range of 0.25–0.5 mm), gas-permeable refractory coating/skin such as mica, silica, alumina, or alumina-silicate, for example. The pattern is embedded in compacted, unbonded sand to form a mold cavity within the sand. Molten metal is then introduced into the mold cavity to melt, pyrolyze, and displace the pattern with molten metal.

Gaseous and liquid decomposition/pyrolysis products escape through the gas-permeable, refractory skin and into the interstices between the unbonded sand particles. The casting rate or rate at which the molten metal enters the mold cavity is limited by the rate the advancing molten metal front can displace the pattern from the cavity. This is affected by the thickness and permeability of the refractory skin/coating. Typical fugitive polymeric foam patterns comprise expanded polystyrene foam (EPS) for aluminum castings and copolymers of polymethylmethacrylate (PMMA) and EPS for iron and steel castings, for example.

The polymeric foam pattern is made by injecting pre-expanded polymer beads into a pattern mold to impart the desired shape to the pattern. For example, raw EPS beads (typically 0.2 to 0.5 mm in diameter) containing a blowing/expanding agent (e.g. n-pentane) are: (1) first, pre-expanded at a temperature above the softening temperature of polystyrene and the boiling point of the blowing agent; and (2) molded into the desired configuration in a steam-heated pattern mold which further expands the beads to fill the pattern mold. Complex patterns and pattern assemblies are made by molding several individual mold segments, and then joining the mold segments by gluing, for example, to form the pattern or pattern assembly.

The molten metal may be either gravity-cast meaning poured from an overhead ladle or furnace, or countergravity-cast. In gravity-cast lost-foam processes, the metallostatic head of the molten metal in the sprue and pouring basin is the driving force for filling the mold cavity with molten metal. Countergravity-cast lost-foam processes involve causing the molten metal to flow upwardly by vacuum or low pressure into the mold cavity from an underlying vessel such as a furnace, for example.

Gravity-cast, lost-foam processes are known that top-fill the mold cavity by pouring the molten metal into a basin overlying the pattern so that the molten metal flows downwardly into the mold cavity through a gating system located above the pattern. Other gravity-cast methods bottom-fill the mold cavity by pouring the molten metal into a vertical sprue that lies adjacent the pattern. The sprue extends from above the mold cavity to below the mold cavity for filling the mold cavity through a gating system located beneath the pattern so that the molten metal flows vertically upwardly into the mold. Additionally, gravity-cast methods can side-fill the mold cavity by pouring the molten metal into a pattern that forms a vertical sprue which lies adjacent the mold cavity. The vertical sprue communicates with the mold cavity via a plurality of vertically aligned runners and gates which horizontally fill the mold cavity from the side. The vertical sprue may be flanked by two or more mold cavities for making multiple castings with a single pour.

Molten metal flow in a lost foam mold is related to the density of the foam pattern. Casting engineers are often challenged with a part configuration which does not lend itself to castability. Features such as long straight rails cause metal to flow through a mold quickly while causing other areas to back-fill. The back-fill areas can be subject to defects such as folds. Computer simulation programs have been used to attempt to adjust gate area and location in an attempt to optimize flow patterns.

It would be desirable to develop a method and apparatus for controlling dispersion of molten metal in a mold cavity for a lost foam casting process wherein the filling of regions of the mold cavity which do not lend themselves to castability is maximized, an amount of backfill and other casting defects are minimized, and a flow pattern of molten metal and material properties of the resulting casting are optimized.

SUMMARY OF THE INVENTION

Consistent and consonant with the present invention, a method and apparatus for controlling dispersion of molten metal in a mold cavity for a lost foam casting process wherein the filling of regions of the mold cavity which do not lend themselves to castability is maximized, an amount of backfill and other casting defects are minimized, and a flow pattern of molten metal and material properties of the resulting casting are optimized, has surprisingly been discovered.

In one embodiment, the apparatus for locally densifying a lost-foam casting pattern for controlling dispersion of molten metal in a mold cavity comprises a pattern die with a cylinder and a pattern forming cavity formed therein, the cylinder in communication with the pattern forming cavity; a squeeze pin slidably disposed in the cylinder of the pattern die; means for applying a force on the squeeze pin, the means for applying a force causing the squeeze pin to slidably move in the cylinder of the pattern die in a direction towards the pattern forming cavity of the pattern die; and a pattern disposed in the pattern forming cavity of the pattern die, wherein a sliding of the squeeze pin causes a localized densification of the pattern.

The invention also provides methods for controlling dispersion of molten metal in a mold cavity.

In one embodiment, the method of controlling a dispersion of molten metal in a mold cavity comprises the steps of providing a pattern having at least one locally densified portion; embedding the pattern in sand to form a mold cavity therein; and introducing molten metal into the mold cavity, wherein the densified portion facilitates a diversion of the molten metal throughout the mold cavity upstream of the densified portion of the pattern to promote a complete filling of the mold cavity.

In another embodiment, the method of controlling a dispersion of molten metal in a mold cavity comprises the steps of providing a pattern die having at least one squeeze pin slidably disposed therein; providing a foam pattern disposed within a pattern forming cavity of the pattern die; compressing a portion of the foam pattern with the squeeze pin to densify a portion of the foam pattern; embedding the foam pattern in sand to form a mold cavity therein; and introducing molten metal into the mold cavity, wherein the densified portion of the foam pattern facilitates a diversion of the molten metal throughout the mold cavity upstream of the densified portion of the foam pattern to promote a complete filling of the mold cavity.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the process disclosed and the flow diagrams illustrated, the steps presented are exemplary in nature, and thus, the order of the steps is not necessary or critical.

Figures 1, 2:
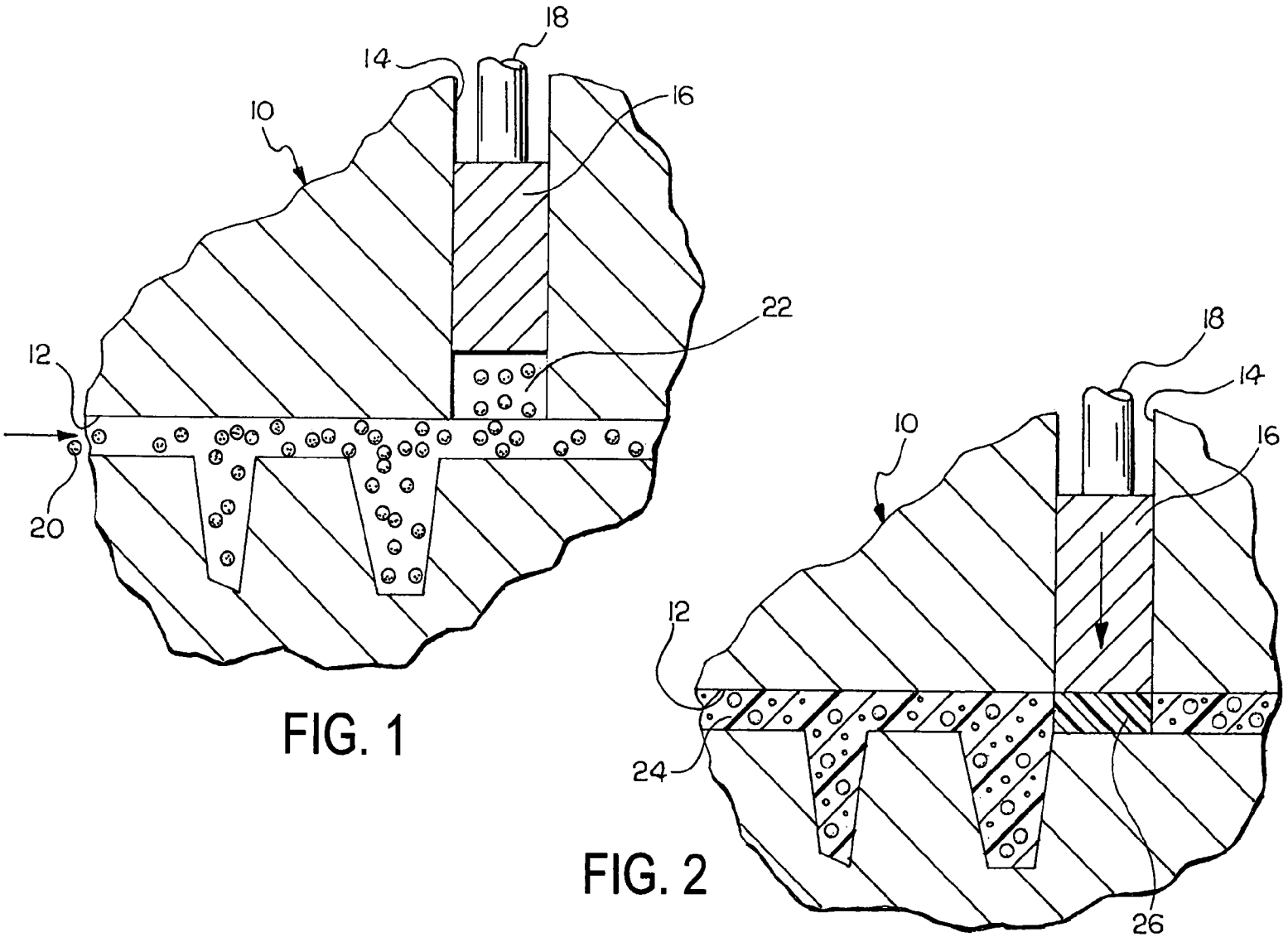
FIG. 1 is a schematic sectional view of a lost foam pattern die including foam densification means according to an embodiment of the invention, and showing the die during a foam filling step.
FIG. 2 is a schematic sectional view of the lost foam pattern die illustrated in FIG. 1 showing the die during a foam densification step.

FIG. 1 depicts a lost foam pattern die 10 according to an embodiment of the invention. The die 10 includes a pattern forming cavity 12 formed therein. The cavity 12 has a shape substantially the same as a desired cast part (not shown). A cylinder 14 is formed in the die 10 and is in communication with the cavity 12. Cylinder as used herein is meant to mean a through-hole, cavity or other chamber adapted to have a sliding member disposed therein.

A squeeze pin 16 is slidably disposed in the cylinder 14. As used herein, pin is meant to include a piston, plug, or other member which is slidable within the cylinder 14. A hydraulic cylinder 18 is adapted to apply a pressure or force to the pin 16 to cause the sliding of the pin 16 within the cylinder 14. It is understood that other means for applying a force can be used such as a rack and pinion gear set, pressurized air, and a spring, for example.

The position and orientation of the pin 16 illustrated in FIG. 1 creates a pocket 22 in the cylinder 14 in communication with the cavity 12 and facilitates a filling of the cavity 12 and the pocket 22 with foam beads 20. The foam beads 20 may be an expandable polystyrene plastic, for example. As used herein, pocket is meant to include a cavity, a chamber, or other volume which can be filled with the foam beads 20. A heat source (not shown) is adapted to apply heat to the die 10.

In order to form a foam pattern 24, the beads 20 are blown or otherwise conveyed or caused to enter the cavity 12 until the cavity 12 is substantially filled with the beads 20. Heat is applied to the die 10 by the heat source, thereby causing the beads 20 to expand and "melt" together to form, the foam pattern 24 as shown in FIG. 2. Although foam has been used herein to form the pattern for exemplary purposes, it is understood that other materials having similar properties can be used without departing from the scope and spirit of the invention.

After the foam pattern 24 has been formed, the pin 16 is caused to slide within the cylinder 14 in the direction shown in FIG. 2. The movement of the pin 16 causes a local compression of the portion of the foam pattern 24 disposed in the pocket 22. As a result, a locally densified portion 26 is created in the foam pattern 24. It is understood that the foam beads 20 can also be compressed prior to the heating step to result in formation of the locally densified portion 26. Once the foam pattern 24 has been formed, the foam pattern 24 is removed from the die 10 and coated with a gas-permeable refractory skin (not shown) such as mica, silica, alumina, or alumina-silicate, for example.

Figure 3:
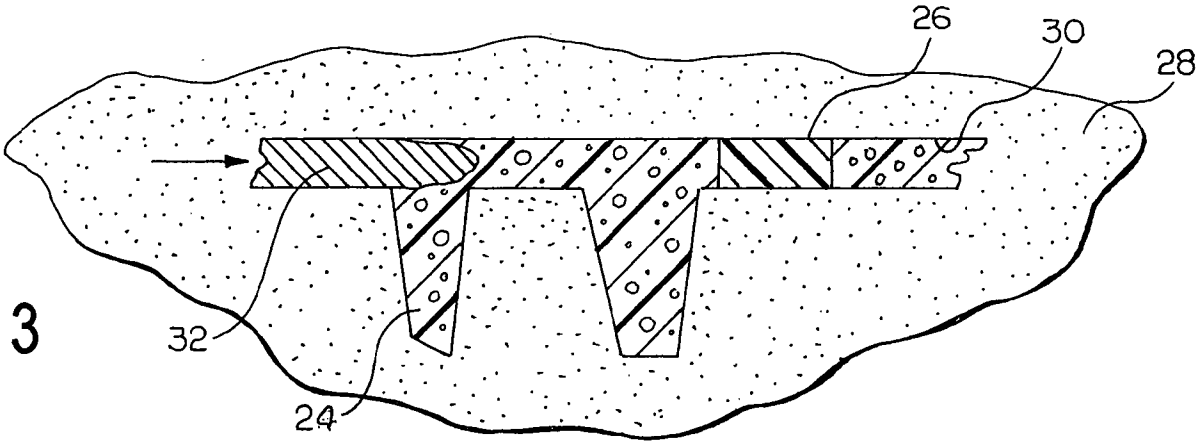
FIG. 3 is a schematic sectional view of a lost foam pattern disposed in sand and showing the pattern during initial stages of a molten metal filling step.

The coated foam pattern 24 is embedded in compacted, unbonded sand 28 as shown in FIG. 3. The foam pattern 24 forms a mold cavity 30 within the sand 28. Molten metal 32 is then introduced into the mold cavity 30 to melt, pyrolyze, and displace the foam pattern 24 with the molten metal 32. Gaseous and liquid decomposition or pyrolysis products (not shown) are permitted to escape through the gas-permeable refractory skin and into the foam pattern 24. The decomposition products then pass through the sand 28. Interstices between the unbonded particles of sand 28 permit the decomposition products to pass therethrough.

Figure 4:
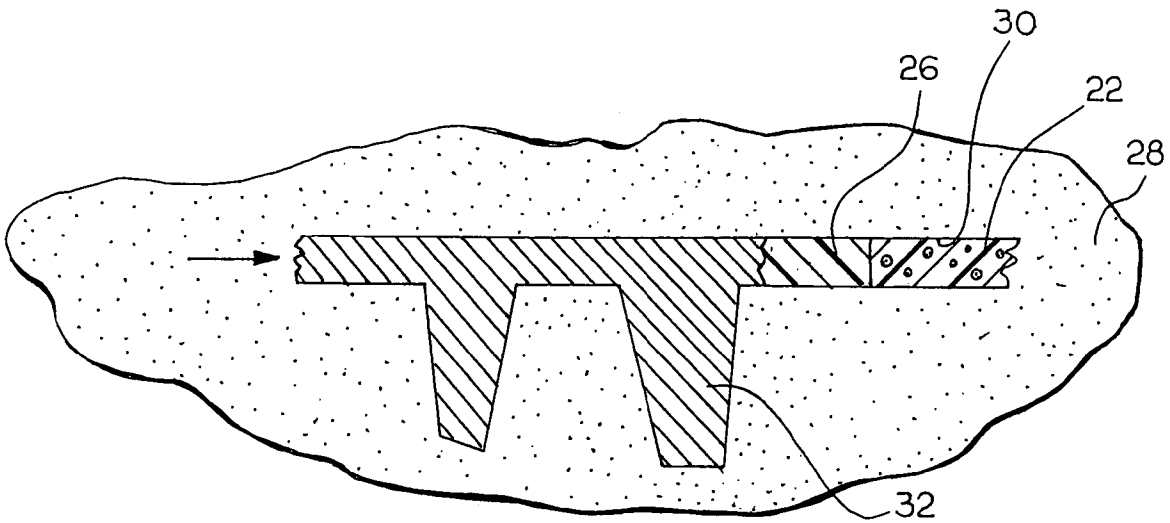
FIG. 4 is a schematic sectional view of the lost foam pattern illustrated in FIG. 3 showing the pattern during the molten metal filling step and prior to metal penetration of the densified foam.

The rate at which the molten metal 32 enters and travels though the mold cavity 30 is limited by the rate the front of advancing molten metal 32 can displace the foam pattern 24 from the mold cavity 30. Thus, when the molten metal 32 reaches the densified portion 26 as shown in FIG. 4, the advancement of the molten metal 32 through the remainder of the mold cavity 30 is delayed, impeded, or slowed. The slowed advancement of the molten metal 32 through the remainder of the mold cavity 30 results in and facilitates the diversion of molten metal 32 throughout the mold cavity 30 and to all areas or sections of the mold cavity 30 upstream of the densified portion 26. Thus, complete filling of the mold cavity 30 is promoted.

Figure 5:
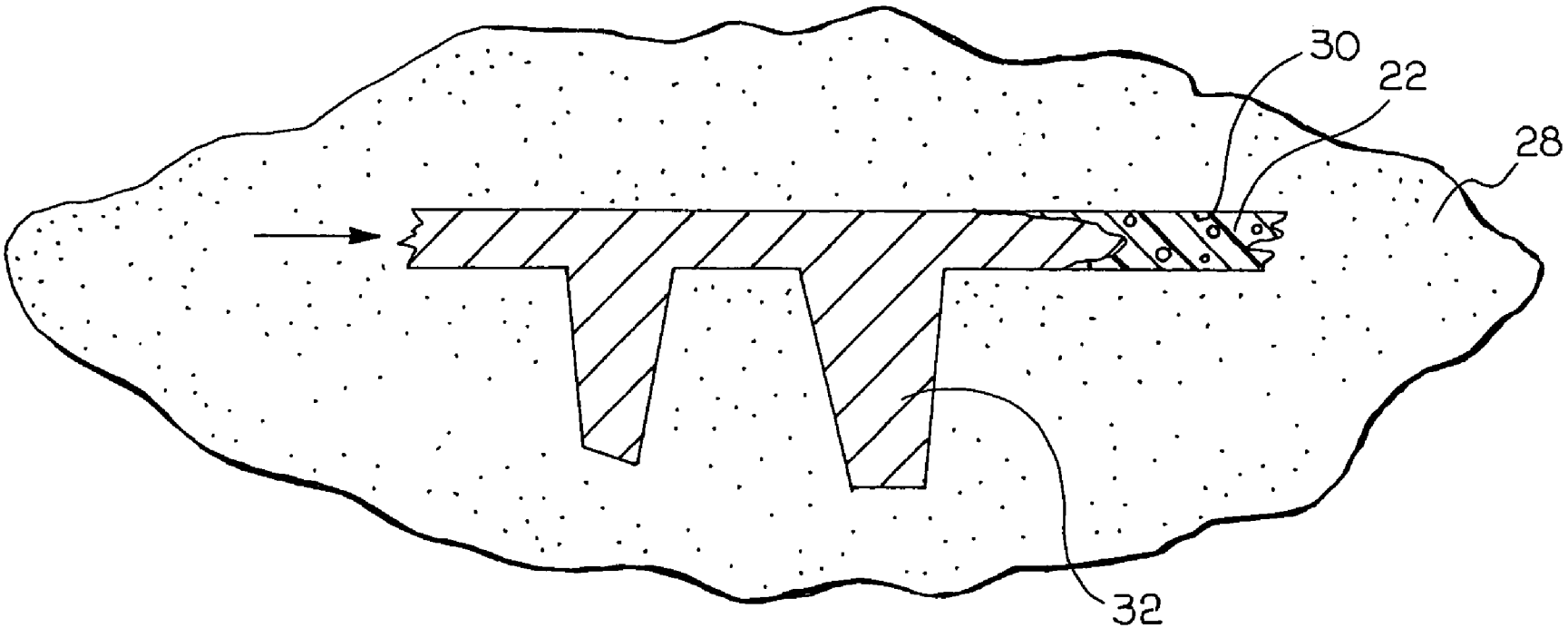
FIG. 5 is a schematic sectional view of the lost foam pattern illustrated in FIGS. 3 and 4 showing the pattern during the molten metal filling step and after metal penetration of the densified foam.

Once the molten metal 32 melts, pyrolyzes, and displaces the densified portion 26, the molten metal 32 is permitted to travel normally though the mold cavity 30, as illustrated in FIG. 5. It is understood that a plurality of densified portions 26 can be used as desired to promote complete filling of the mold cavity 30. Computer simulation programs can be used to determine locations of the densified portions 26 in an attempt to optimize flow patterns of the molten metal 32 through the mold cavity 30.

It is understood that other methods of local densification of the foam pattern 24 can be used. One such method involves producing a plurality of foam patterns 24 of different densities. The plurality of foam patterns 24 are then bonded together to form a single foam pattern 24 representing a desired final shape and configuration of the casting. The plurality of foam patterns can be bonded together using any conventional means such as gluing, heat welding, or other bonding method as desired, for example. The foam pattern 24 is embedded in sand 28.

Numerous advantages result from the method and apparatus of the invention described herein. The advantages include a minimization of casting defects such as backfill. Additionally, voids in the resultant casting are minimized, since complete filling of the mold cavity 30 including runners and the like is promoted. These advantages, and others, result in an overall reduction in scrap produced.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A method of controlling a dispersion of molten metal in a mold cavity comprising the steps of:

providing a pattern having at least one locally densified portion;

embedding the pattern in sand to form a mold cavity therein; and introducing molten metal into the mold cavity, wherein the densified portion facilitates a diversion of the molten metal throughout the mold cavity upstream of the densified portion of the pattern to promote a complete filling of the mold cavity.

2. The method according to claim 1, further comprising the step of providing a pattern die having at least one squeeze pin disposed therein, wherein the densified portion of the pattern is produced by the squeeze pin.

3. The method according to claim 2, wherein the squeeze pin is slidable within a cylinder to compress a portion of the pattern and produce the densified portion.

4. The method according to claim 3, wherein the squeeze pin is caused to slide by pressure application means.

5. The method according to claim 4, wherein the pressure application means is a hydraulic cylinder.

6. The method according to claim 1, wherein the densified portion is produced by providing a plurality of patterns of different densities and bonding the plurality of patterns to produce the pattern.

7. The method according to claim 6, wherein the plurality of patterns are bonded by heat welding.

8. The method according to claim 6, wherein the plurality of patterns are bonded by gluing.

9. A method of controlling a dispersion of molten metal in a mold cavity comprising the steps of:

providing a pattern die having at least one squeeze pin slidably disposed therein;

providing a foam pattern disposed within a pattern forming cavity of the pattern die;

compressing a portion of the foam pattern with the squeeze pin to densify a portion of the foam pattern;

embedding the foam pattern in sand to form a mold cavity therein; and introducing molten metal into the mold cavity, wherein the densified portion of the foam pattern facilitates a diversion of the molten metal throughout the mold cavity upstream of the densified portion of the foam pattern to promote a complete filling of the mold cavity.

10. The method according to claim 9, wherein the squeeze pin is caused to slide by pressure application means.

11. The method according to claim 10, wherein the pressure application means is a hydraulic cylinder.

12. The method according to claim 9, wherein the densified portion is produced by providing a plurality of patterns of different densities and bonding the plurality of patterns to produce the foam pattern.

13. The method according to claim 12, wherein the plurality of patterns are bonded by heat welding.

14. The method according to claim 12, wherein the plurality of patterns are bonded by gluing.

* * * * *